US007930175B2

(12) United States Patent
Haulick et al.

(10) Patent No.: US 7,930,175 B2
(45) Date of Patent: Apr. 19, 2011

(54) BACKGROUND NOISE REDUCTION SYSTEM

(75) Inventors: Tim Haulick, Blaubeuren (DE); Martin Roessler, Ulm (DE); Klaus Alois Haindl, Vienna (DE)

(73) Assignee: Nuance Communications, Inc., Burlington, MA (US)

( * ) Notice: Subject to any disclaimer, the term of this patent is extended or adjusted under 35 U.S.C. 154(b) by 967 days.

(21) Appl. No.: 11/767,803

(22) Filed: Jun. 25, 2007

(65) Prior Publication Data

US 2008/0027722 A1 Jan. 31, 2008

(30) Foreign Application Priority Data

Jul. 10, 2006 (EP) ..... 06014256

(51) Int. Cl.
*G10L 21/02* (2006.01)

(52) U.S. Cl. ..... 704/226; 704/216; 381/71.2

(58) Field of Classification Search ..... 704/216–218, 704/226; 381/71.1, 71.2
See application file for complete search history.

(56) References Cited

U.S. PATENT DOCUMENTS 5,848,163 A * 12/1998 Gopalakrishnan et al. ..... 381/56

FOREIGN PATENT DOCUMENTS

| | | |
|---|---|---|
| EP | 0 411 360 | 2/1991 |
| EP | 0411360 A1 | 2/1991 |
| WO | WO 00/14731 | 3/2000 |
| WO | WO 03/017718 | 2/2003 |

OTHER PUBLICATIONS

Japanese Publication By Ichikawa; IEICE Trans. Fundamentals, vol. E88-. No. 7 Jul. 2005.

* cited by examiner

*Primary Examiner* — Abul Azad
(74) *Attorney, Agent, or Firm* — Sunstein Kann Murphy & Timbers LLP

(57) ABSTRACT

A noise reduction system includes a microphone configured to detect an acoustic signal. A first digitizer converts an output of the microphone into a discrete output signal. An acoustic sensor detects structure-borne noise, and a second digitizer converts an output of the acoustic sensor into a discrete acoustic noise reference signal. A noise compensation circuit processes the discrete output signal based on the discrete acoustic noise reference signal.

20 Claims, 8 Drawing Sheets

BACKGROUND NOISE REDUCTION SYSTEM

BACKGROUND OF THE INVENTION

1. Priority Claim

This application claims the benefit of priority from European Patent Application No. 06 014256.9, filed Jul. 10, 2006, which is incorporated by reference.

2. Technical Field

This disclosure relates to noise reduction. In particular, this disclosure relates to reduction of background noise in a hands-free vehicle communication system.

3. Related Art

The voice quality of vehicle communication systems, such as wireless telephone systems, may be degraded by background noise. Spectral subtraction circuits have been used to reduce noise, but are limited to processing stationary noise perturbations and positive signal-to-noise distances.

Microphone arrays and fixed beamforming techniques have also been used to improve the quality of transmitted speech. However, use of multiple microphones or microphone arrays may be limited by spatial restrictions and cost considerations. To reduce broadband noise, a reference signal should be detected close to the source of the primary signal. However, additional reference microphones placed near the primary signal source necessarily detect portions of the desired speech signal, causing distortion and damping of the audio speech signal.

Existing hands-free communication systems in vehicle environments do not provide adequate background noise reduction. Therefore, a need exists for a background noise reduction system that reduces background noise in a vehicle environment.

SUMMARY

A noise reduction system includes a microphone that detects an acoustic signal. A first digitizer converts an output of the microphone into a discrete output signal. An acoustic sensor detects structure-borne noise, and a second digitizer converts an output of the acoustic sensor into a discrete acoustic noise reference signal. A noise compensation circuit processes the discrete output signal based on the discrete acoustic noise reference signal to generate a noise compensated digital audio signal.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION OF THE PREFERRED EMBODIMENTS

Figure 1:
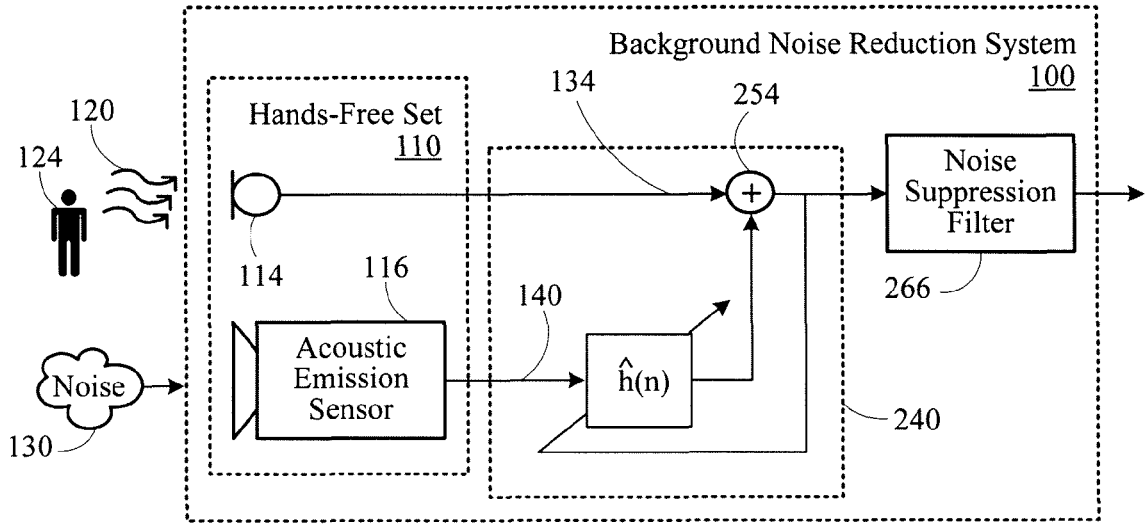
FIG. 1 is a background noise reduction system.

FIG. 1 is a background noise reduction system 100. The background noise reduction system 100 may include a hands-free set 110 having a microphone 114 and an acoustic emission sensor 116. The microphone 114 may detect utterances 120 of a speaker 124, and the acoustic emission sensor 116 may detect a structure-borne noise component 130. The hands-free set 110 may be installed in a vehicle passenger compartment. The background noise reduction system 100 may improve the quality of a speech signal detected by the microphone 114. The microphone 114 may generate a microphone output signal 134 representing the speaker's utterance along with the structure-borne noise component. The acoustic emission sensor 116 may generate a structure-borne noise reference signal 140 based on the detected structure-borne noise.

Figure 2:
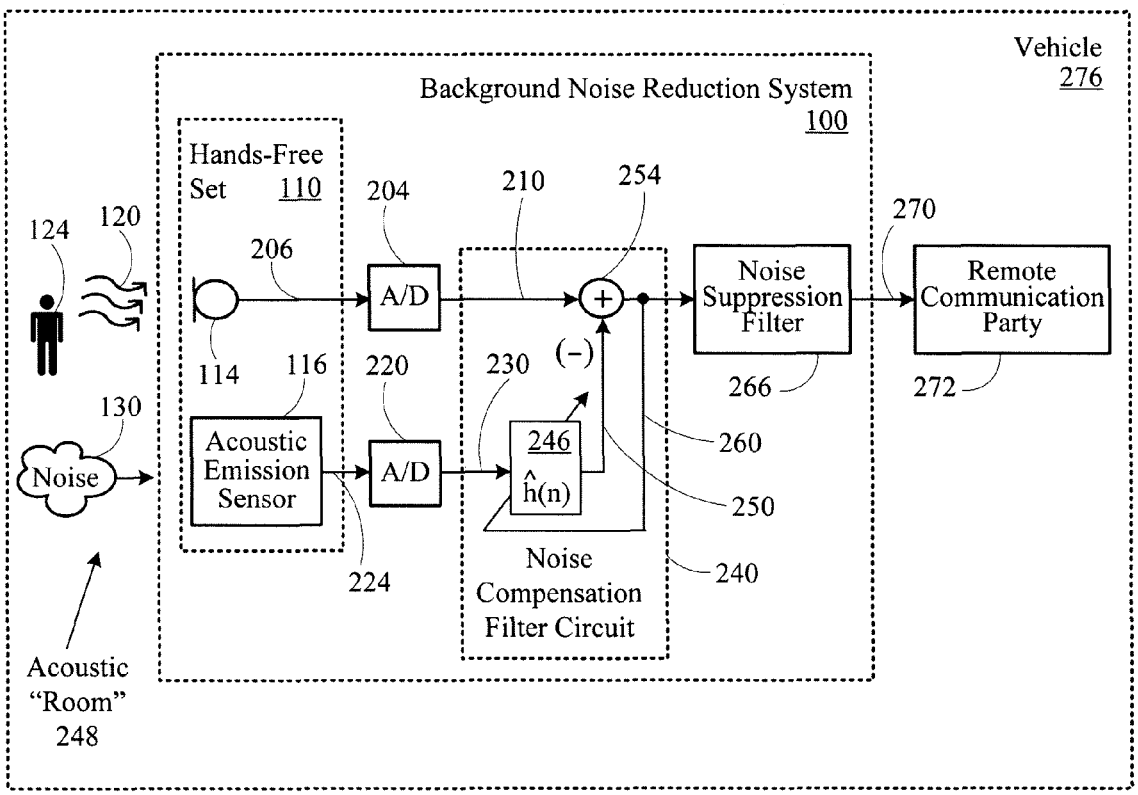
FIG. 2 is a background noise reduction system having analog-to-digital converters.

FIG. 2 shows a first analog-to-digital (A/D) converter 204. The first A/D converter 204 may digitize an analog output 206 of the microphone 114 to generate a digitized microphone output signal 210 (discrete output signal). A second A/D converter 220 may digitize an analog output 224 of the acoustic emission sensor 116 to generate a digitized structure-borne noise reference signal 230.

A noise compensation filter circuit 240 may receive the digitized microphone output signal 210 and the digitized structure-borne noise reference signal 230. The noise compensation filter circuit 240 may include a linear finite impulse response filter (FIR) 246. Alternatively, the noise compensation filter circuit 240 may include an infinite impulse response filter (IIR). An infinite impulse response filter may be recursive and may have a shorter length (number of taps) than a finite impulse response filter.

Filter coefficients corresponding to the noise compensation filter circuit 240 may be adapted using a normalized least mean square (NLMS) process. The coefficients may be calculated by processes described in a publication entitled "Acoustic Echo and Noise Control," by Hänsler and G. Schmidt. The filter adaptation process may be based on other processes, such as a recursive least mean squares process and a proportional least mean squares process. Further variations of the adaptation process may be used to ensure that the output of the filter does not diverge.

The filter coefficients may model the transfer function or impulse response of the vehicle passenger compartment or "acoustic room" 248 in which the microphone 114 is installed. The filter coefficients may be continuously adapted to provide a noise estimate signal 250 representative of the structure-borne noise reference signal 230.

A subtraction circuit 254 may subtract the noise estimate signal 250 from the digitized microphone output signal 210 to obtain a noise compensated signal 260. A noise suppression filter 266 may further enhance the quality of the noise compensated signal 260 to provide an enhanced noise compensated signal 270. The noise suppression filter 266 may be a spectral subtraction filter. In some applications, the system may include an echo compensating circuit and/or and equalizing circuit.

The enhanced noise compensated signal 270 may be transmitted to a remote communication party 272 through a communication device, such as through a wireless communication device. The remote communication party 272 may be located outside the vehicle 276. Alternatively, the remote communication party 272 may be a vehicle passenger located within the vehicle 276 so that the front-seat passenger and the rear-seat passenger may communicate with each other and/or the remote communication party 272.

Figure 3:
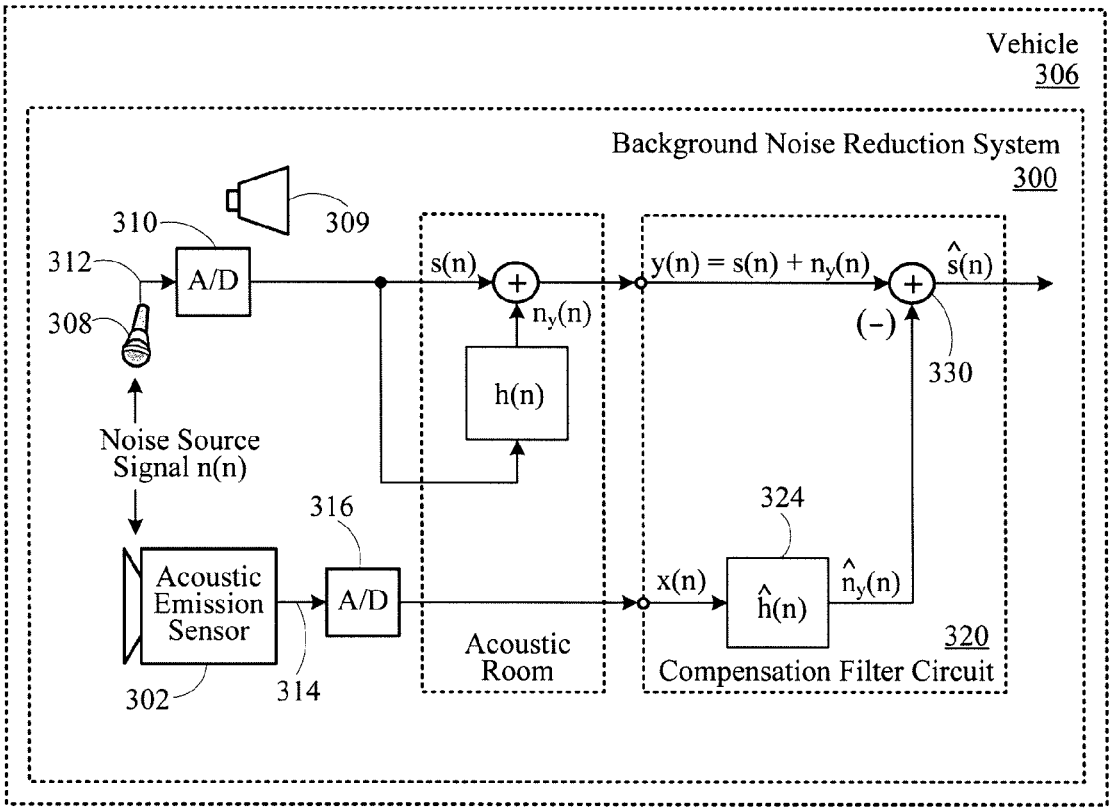
FIG. 3 is a background noise reduction system having an acoustic emission sensor.

FIG. 3 is a background noise reduction system 300 having an acoustic emission sensor 302. The background noise reduction system 300 is shown in a vehicle 306. At least one microphone 308 and at least one loudspeaker 309 may be located in the vehicle 306. The microphone 308 and loudspeaker 309 may be part of a communication system installed in the vehicle 306. Alternatively, at least one microphone 308 and at least one loudspeaker 309 may be provided for each passenger seat.

The vehicle environment 306 may represent an "acoustic room," which may exhibit audio reverberation. The microphone 308 may detect sound in the form of an acoustic signal. An A/D converter 310 may digitize an analog output 312 of the microphone 308 to generate a digitized microphone output signal y(n). The argument n denotes a discrete time index. The sampling rate of the A/D converter 310 may be selected to capture any desired frequency content. For speech, the sampling rate may be approximately 8 kHz to about 22 kHz. The digitized microphone output signal y(n) may include a digitized speech signal component s(n) generated by the utterance of the speaker. The digitized microphone output signal y(n) may also include a digitized noise component $n_y(n)$.

The noise component $n_y(n)$ may correspond to a noise source signal n(n) provided by the acoustic emission sensor 302. An analog output 314 of the acoustic emission sensor 302 may be digitized by an analog-to-digital converter 316. The noise component $n_y(n)$ may result from the transfer function or impulse response of the noise source signal n(n) based on the acoustic properties of the acoustic room. The acoustic emission sensor 302 may receive the noise source signal n(n) and may generate a digital noise reference signal x(n). The transfer function may be approximated by a discrete linear coefficient system h(n), where h(n)=h1($n$), . . . , $h_N$(n). The impulse response may be modeled by a compensation filter circuit 320.

The compensation filter circuit 320 may include a FIR filter 324 or a digital signal processor (DSP) having a plurality of filter coefficients. The DSP may execute instructions that delay an input signal one or more cycles, track frequency components of a signal, filter a signal, and/or attenuate or boost an amplitude of a signal. Alternatively, the filter or DSP may be implemented as discrete logic or circuitry, a mix of discrete logic and a processor, or may be distributed through multiple processors or software programs. The coefficients may be continuously or periodically adapted using a normalized least means squares (NLMS) process. The filter adaptation process may be based on other processes, such as a recursive least mean squares process and a proportional least mean squares process. Further variations of the adaptation process may be used to ensure that the output of the filter does not diverge.

The compensation filter circuit 320 may receive the digitized microphone output signal y(n) and the digital noise reference signal x(n). Noise compensation may be performed in the time domain or in the frequency domain. The digital noise reference signal x(n) may be correlated with the noise component $n_y(n)$ of the digitized microphone output signal y(n). The digital noise reference signal x(n) may be filtered by the FIR filter 324 to obtain a noise estimate signal $\hat{n}_y(n)$.

A Fast Fourier Transformation (FFT) process may be used. The digital noise reference signal x(n) may be smoothed in the time domain and/or the frequency domain.

The filter coefficients of the FIR filter 324 may adapt so that the noise estimate signal $\hat{n}_y(n)$ approximates the noise component $n_y(n)$ of the digitized microphone output signal y(n). The noise estimate signal $\hat{n}_y(n)$ may be estimated according to the following equation:

$$\hat{n}_y(n) = \sum_{k=0}^{N-1} \hat{h}_k(n)x(n-k).$$

A subtraction circuit 330 may subtract the noise estimate signal $\hat{n}_y(n)$ from the digitized microphone output signal y(n) to obtain a noise compensated signal $\hat{s}(n)$.

The digital noise reference signal x(n) obtained from the acoustic emission sensor 302 may provide an estimate of the perturbation component of the audio signal. The estimated perturbation component may be subtracted from the digitized microphone output signal y(n) to increase the signal-to-noise ratio. The intelligibility of speech signals may be enhanced because non-vocal perturbations are subtracted from the digitized microphone output signal.

Figure 4:
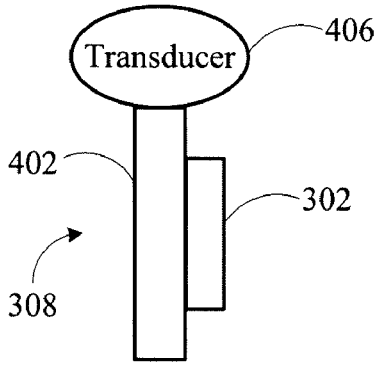
FIG. 4 is a microphone housing and an acoustic emission sensor.

FIG. 4 shows the acoustic emission sensor 302 that may be part of the microphone 308 or a microphone housing 402. A transducer 406 may be mounted on the housing 402 along with the acoustic emission sensor 302. In some applications, the acoustic emission sensor 302 may be located near the microphone housing 402. In other applications, a plurality of acoustic emission sensors 302 may provide a combined noise reference signal.

Figure 5:
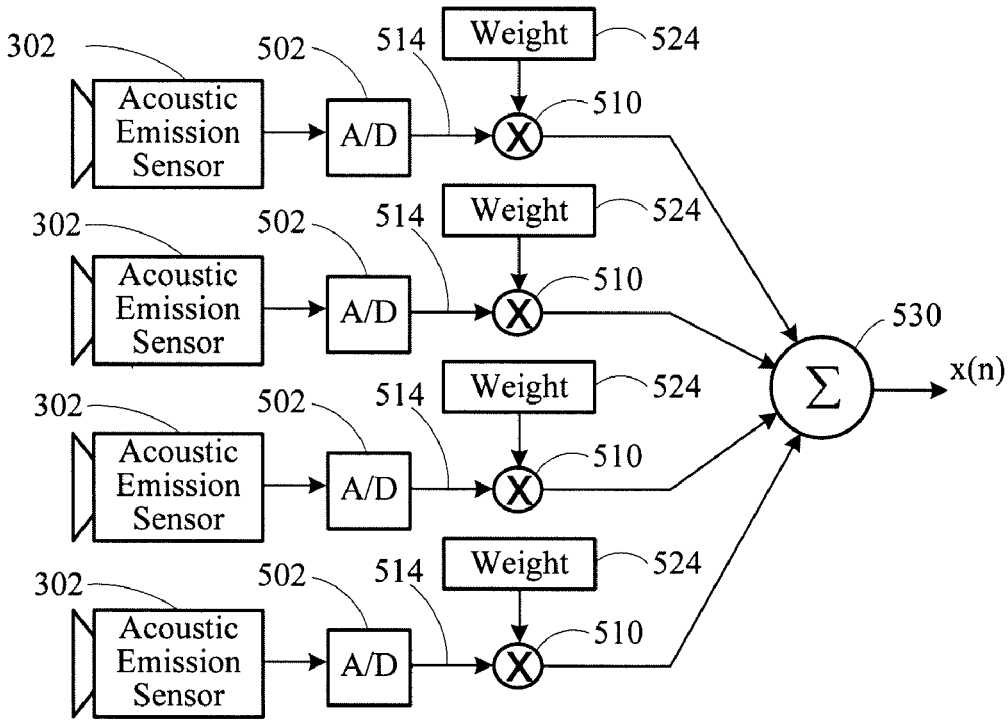
FIG. 5 shows multiple acoustic emission sensors.

FIG. 5 shows a plurality of acoustic emission sensors 302. One or more acoustic emission sensors 302 may be positioned in the passenger compartment and/or in the engine compartment of the vehicle 306. An A/D converter 502 may convert the analog output of each acoustic emission sensor 302 into digital form. A multiplier circuit 510 may scale the digital signal 514 from each A/D converter by a weight factor circuit 524 to adjust the respective signal contribution. The output of each multiplier circuit may be summed by a summing circuit 530. The location of the acoustic emission sensors 302 may be based upon the vehicle design and model and/or on the installed vehicle communication system.

Each acoustic emission sensor 302 may be a vibration sensor adapted to detect rapid linear movements, such as the structure-borne noise. The acoustic emission sensor 302 may detect vibrations in a low frequency range up to about several hundred Hertz. The acoustic emission sensor 302 may be made of a plastic film, such as polyvinylidene fluoride, or may be made of a piezo-ceramic material or active fiber composite elements to detect structure-borne noise, such as impact sound. The acoustic emission sensor 302 may include a sensing pin in contact with a surface of a body, such as an engine component. The sensing pin may be resiliently urged against the surface of the body. A sound wave traveling through the body may generate a voltage potential via the sensing pin. The voltage potential may be processed to obtain the digital reference noise signal.

The acoustic emission sensor may detect noise. The digital noise reference signal x(n) generated by the acoustic emission sensor may be substantially free of speech signal components, even when positioned close to the microphone used by a speaker.

Figure 6:
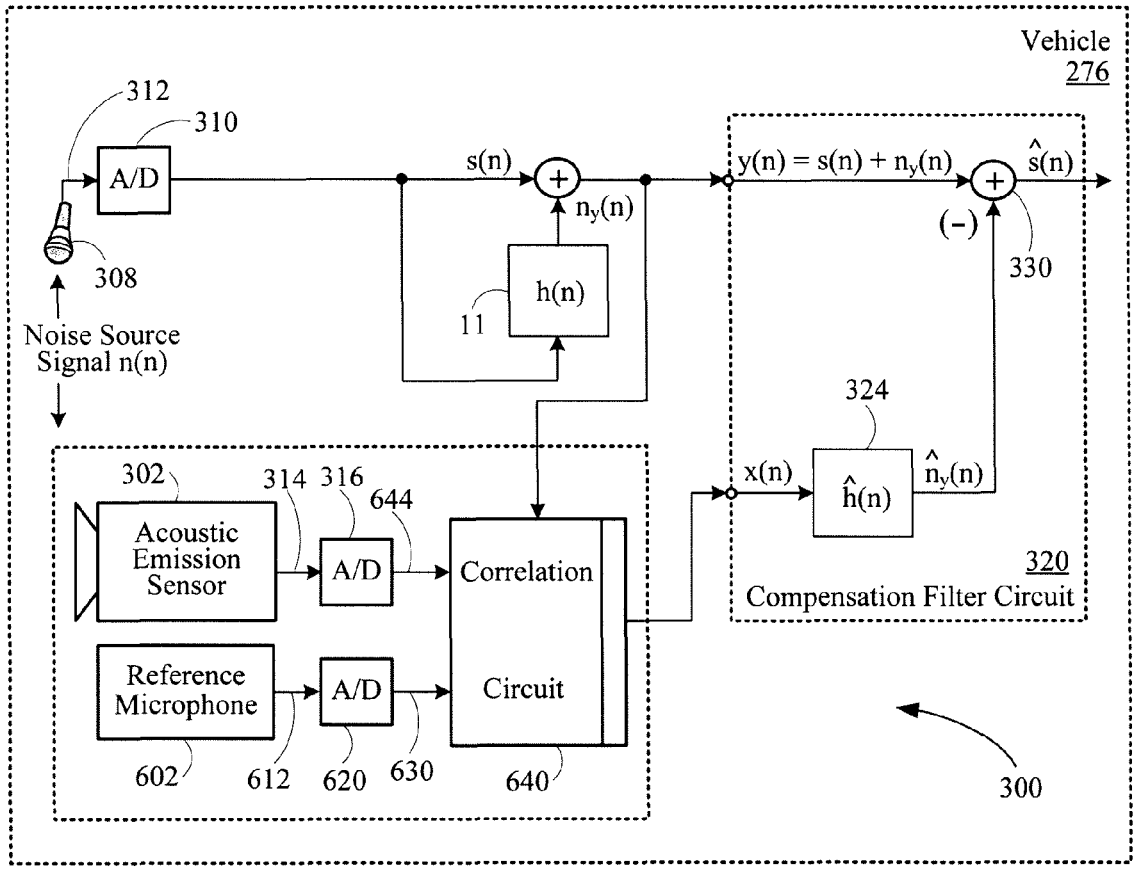
FIG. 6 is a background noise reduction system having a reference microphone.

FIG. 6 is the background noise reduction system 300 having a reference microphone 602 and the acoustic emission sensor 302. In some systems, the acoustic sensor 302 may not be used. In some systems, two noise source signals may be processed, with a first noise source signal 612 generated by the reference microphone 602, and the second noise source signal 314 generated by one or more of the acoustic emission sensors 302.

The reference microphone 602 may detect noise and may be sensitive in the frequency range below about 200 Hz. The reference microphone 602 may not be sensitive to noise in a range from about 200 Hz to about 3500 Hz, which may correspond to a portion of the intelligible speech signals. An A/D converter 620 may digitize the analog output 612 of the reference microphone 602 to generate a discrete reference microphone noise signal 630

A correlation circuit 640 may receive the digitized reference microphone noise signal 630 from the reference microphone 602. The correlation circuit 640 may separately receive a discrete output 644 provided by the A/D converter 316 corresponding to the acoustic emission sensor 302.

The correlation circuit 640 may determine a correlation between the digital microphone signal y(n) (which may contain the speech signal and the noise component), and the digitized reference microphone noise signal x(n). The correlation circuit 640 may separately determine a correlation between the digital microphone signal y(n) and the digitized output of the acoustic emission sensor x(n). The term x(n) may represent either of the noise signal sources.

The correlation circuit 640 may calculate the squared magnitude of the coherence of the digital microphone signal y(n) and the digitized reference microphone noise signal x(n) according to the following equation:

$$C_{xy}(\omega) = \frac{|X*(\omega)Y(\omega)|^2}{(Y*(\omega)Y(\omega))(Y*(\omega)Y(\omega))},$$

where X (ω) and Y(ω) may denote the discrete Fourier spectra of x(n) and y(n) and the asterisk may denote the complex conjugate. The Fourier transformation may be performed using a Fast Fourier Transformation, such as a Cooley-Tukey process. A similar process may be performed using the digitized output of the acoustic emission sensor.

For two arbitrary signals, a(n) and b(n), the cross power density spectrum may be represented as A*(ω) B(ω), where A(ω) and B(ω) are the Fourier spectra of a and b, respectively, ω is the frequency coordinate in frequency space, and the asterisk denotes the complex conjugate. The coherence may be given by the ratio of the cross power density spectrum and the geometric mean of the auto correlation power density spectra. The squared magnitude of the coherence of a(n) and b(n) may be determined according to the equation below:

$$C_{ab}(\omega) = \frac{|A*(\omega)B(\omega)|^2}{(A*(\omega)A(\omega))(B*(\omega)B(\omega))}.$$

The coherence may describe the linear functional interdependence between the two signals. If the signals are completely uncorrelated, the coherence is about zero. The maximum noise compensation that may be available by linear noise compensation filtering may be defined as $1-C_{ab}(\omega)$ in the frequency domain. This may represent a noise damping of about 10 dB for a coherence of about 0.9.

If the squared magnitude of the coherence value is greater than a predetermined threshold, the noise compensation filter circuit may provide the noise estimate signal $\hat{n}_y(n)$ using the digitized reference microphone noise signal. If the squared magnitude of the coherence value is less than or equal to the predetermined threshold, the noise compensation filter circuit may provide the noise estimate signal $\hat{n}_y(n)$ using the digitized output of the acoustic emission sensor 644. The predetermined threshold value may be about 0.85. An amount of noise damping (measured in dB) may be proportional to the squared magnitude of the coherence value. The quality of the output of the noise compensation filter circuit 300 may increase as the coherence value increases.

In some applications, both the digitized reference microphone noise signal 630 and the digitized output of the acoustic emission sensor(s) 644 may be buffered and processed. The output of one or more of the acoustic emission sensors 302 may be processed.

Figure 7:
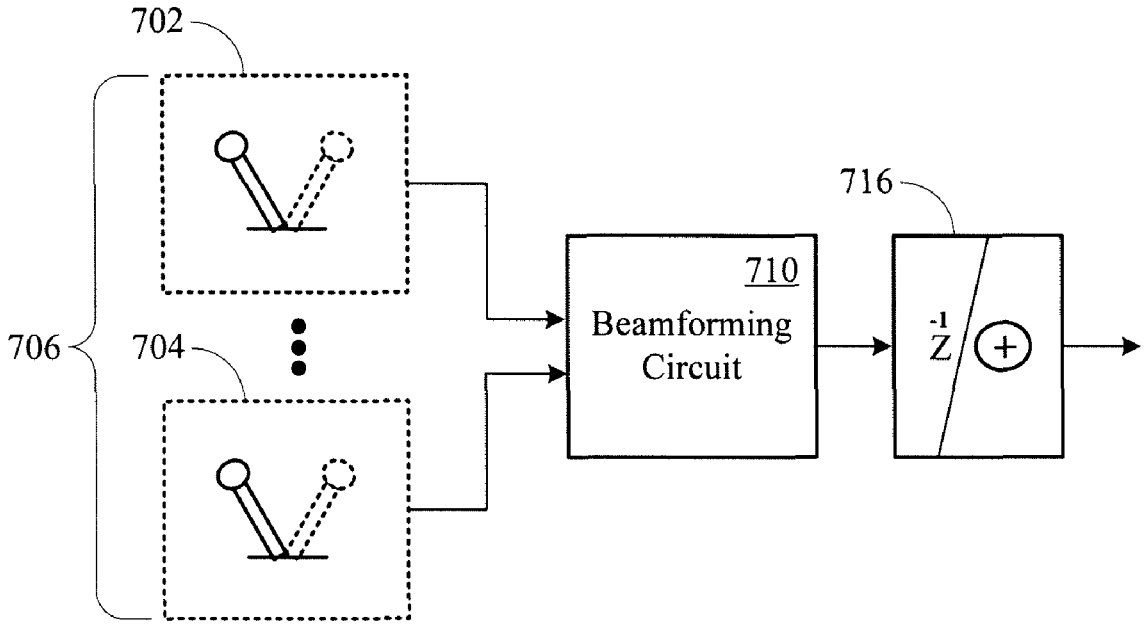
FIG. 7 is a beamforming circuit.

FIG. 7 shows that the microphone used for speech may be replaced by a directional microphone 702, a plurality of directional microphones 702 and 704, or a microphone array 706 having at least one directional microphone. A beamforming circuit 710 may process the signals from the speech microphone(s) 702 and 704. The signals may be further processed by a "delay-and-sum" circuit 716.

Figure 8:
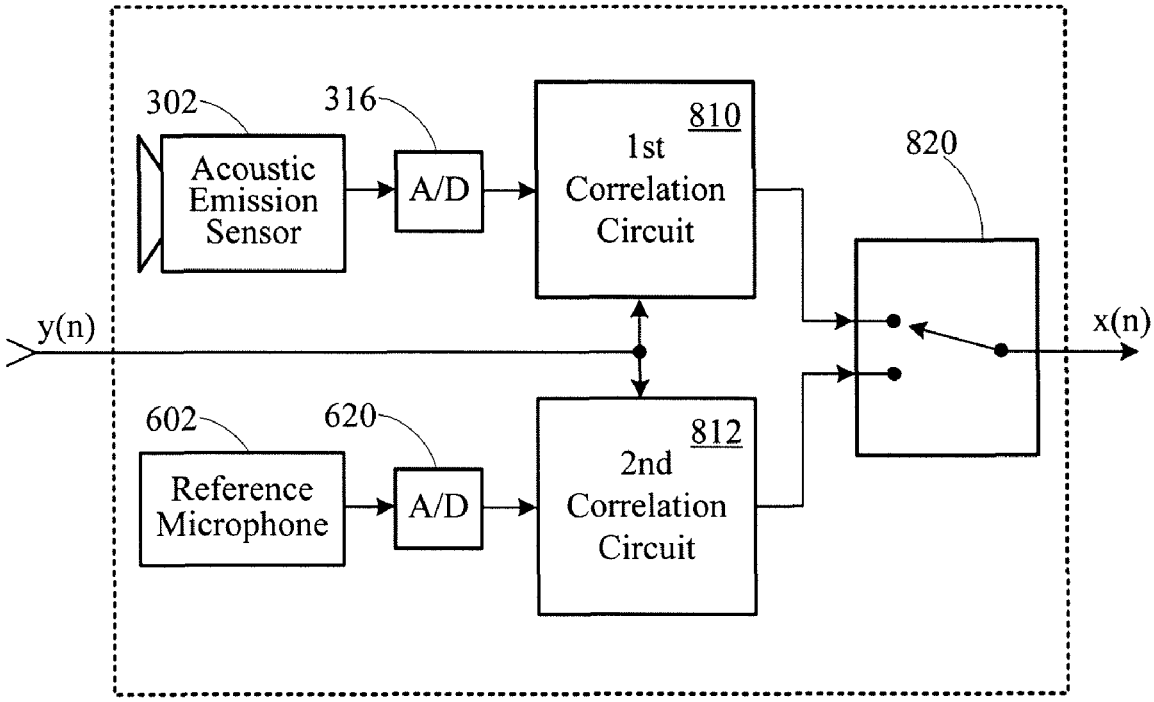
FIG. 8 shows separate correlation circuits.

FIG. 8 shows two separate and independent correlation circuits. A first correlation circuit 810 may process the digital microphone signal y(n) and the digitized output of the acoustic emission sensor x(n). A second correlation circuit 812 may process the digital microphone signal y(n) and the digitized reference microphone noise signal x(n). A switch 820 may select between the two signals depending upon the calculated correlation value.

Figure 9:
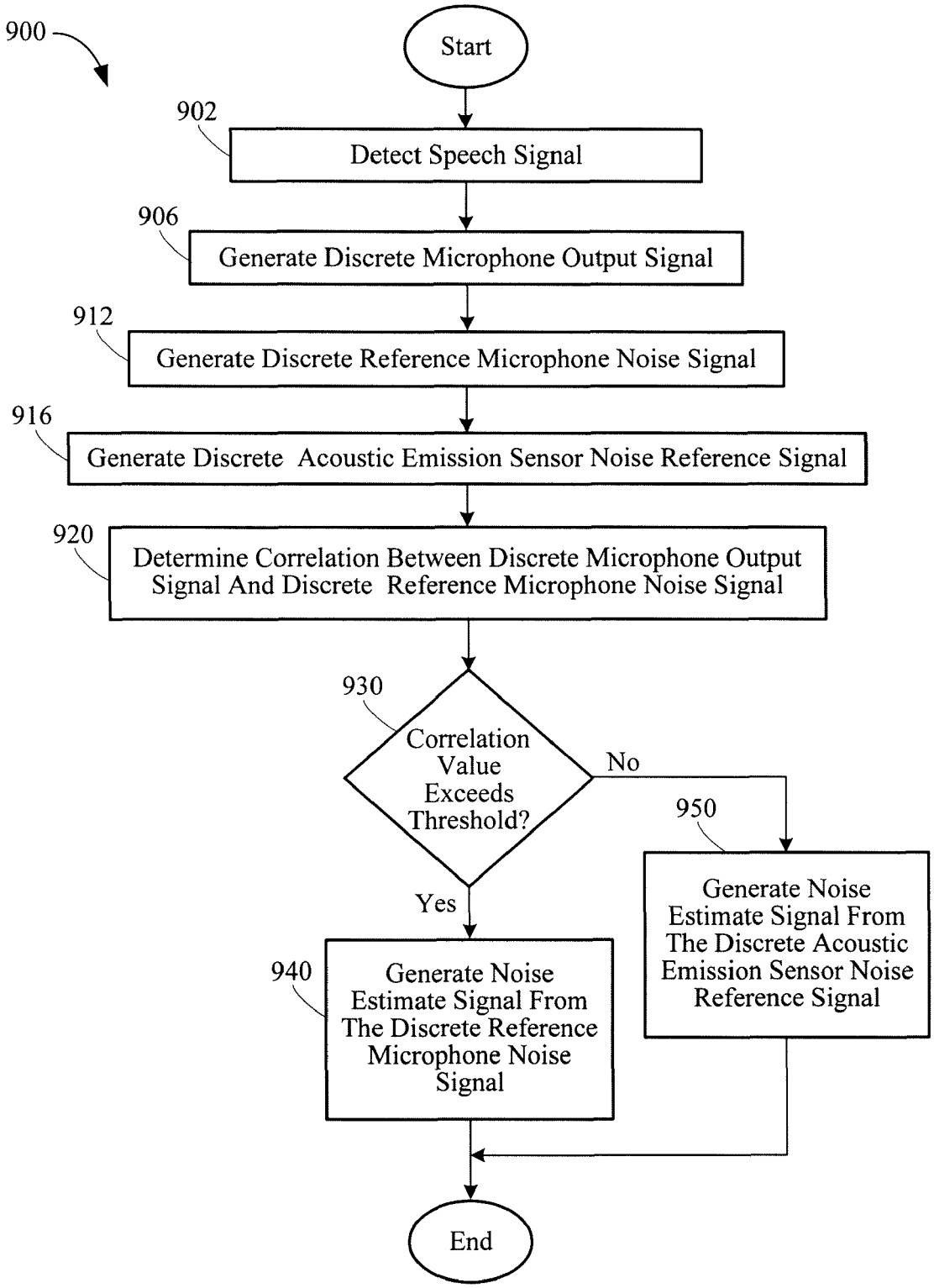
FIG. 9 is a noise reduction process.

FIG. 9 is a noise reduction process 900. Speech may be detected by a microphone (Act 902). The output of the microphone may be digitized (Act 906) to provide a discrete microphone output signal. A noise reference, referred to as the digitized reference microphone noise signal, may be generated based on the output of the reference microphone (Act 912). Similarly, a noise reference signal, referred to as the digitized acoustic emission sensor noise reference signal, may be generated based on the output of one or more of the acoustic emission sensors (Act 916). The correlation circuit may determine a correlation between the digitized microphone output signal and the digitized reference microphone noise signal (Act 920). If the correlation value is greater than a predetermined threshold (Act 930), a noise estimate signal may be generated using the digitized reference microphone noise signal (Act 940). If the correlation value is less than or equal to the predetermined threshold, a noise estimate signal may be generated using the digitized acoustic emission sensor noise reference signal (Act 950).

The logic, circuitry, and processing described above may be encoded in a computer-readable medium such as a CDROM, disk, flash memory, RAM or ROM, an electromagnetic signal, or other machine-readable medium as instructions for execution by a processor. Alternatively or additionally, the logic may be implemented as analog or digital logic using hardware, such as one or more integrated circuits (including amplifiers, adders, delays, and filters), or one or more processors executing amplification, adding, delaying, and filtering instructions; or in software in an application programming interface (API) or in a Dynamic Link Library (DLL), functions available in a shared memory or defined as local or remote procedure calls; or as a combination of hardware and software.

The logic may be represented in (e.g., stored on or in) a computer-readable medium, machine-readable medium, propagated-signal medium, and/or signal-bearing medium. The media may comprise any device that contains, stores, communicates, propagates, or transports executable instructions for use by or in connection with an instruction executable system, apparatus, or device. The machine-readable medium may selectively be, but is not limited to, an electronic, magnetic, optical, electromagnetic, or infrared signal or a semiconductor system, apparatus, device, or propagation medium. A non-exhaustive list of examples of a machine-readable medium includes: a magnetic or optical disk, a volatile memory such as a Random Access Memory "RAM," a Read-Only Memory "ROM," an Erasable Programmable Read-Only Memory (i.e., EPROM) or Flash memory, or an optical fiber. A machine-readable medium may also include a tangible medium upon which executable instructions are printed, as the logic may be electronically stored as an image or in another format (e.g., through an optical scan), then compiled, and/or interpreted or otherwise processed. The processed medium may then be stored in a computer and/or machine memory.

The systems may include additional or different logic and may be implemented in many different ways. A controller may be implemented as a microprocessor, microcontroller, application specific integrated circuit (ASIC), discrete logic, or a combination of other types of circuits or logic. Similarly, memories may be DRAM, SRAM, Flash, or other types of memory. Parameters (e.g., conditions and thresholds) and other data structures may be separately stored and managed, may be incorporated into a single memory or database, or may be logically and physically organized in many different ways. Programs and instruction sets may be parts of a single program, separate programs, or distributed across several memories and processors. The systems may be included in a wide variety of electronic devices, including a cellular phone, a headset, a hands-free set, a speakerphone, communication interface, or an infotainment system.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method for reducing background noise in an audio signal, comprising:

converting sound into an analog signal;

digitizing the analog signal to obtain a discrete output signal;

detecting structure-borne noise by an acoustic emission sensor to obtain an acoustic noise reference signal;

digitizing the acoustic noise reference signal to obtain a discrete acoustic noise reference signal; and detecting noise to obtain a reference noise signal;

digitizing the reference noise signal to obtain a discrete reference noise signal;

calculating a correlation between the discrete output signal and the discrete acoustic noise reference signal to obtain a first correlation value;

calculating a correlation between the discrete output signal and the discrete reference noise signal to obtain a second correlation value;

adaptively filtering the discrete acoustic noise reference signal to obtain a noise estimate signal, if the first correlation value is greater than the second correlation value;

adaptively filtering the discrete reference noise signal to obtain the noise estimate signal, if the first correlation value is not greater than the second correlation value; and subtracting the noise estimate signal from the discrete output signal to obtain a noise compensated digital audio signal.

2. The method of claim 1 further comprising processing the sound into a plurality of analog signals.

3. The method of claim 1 further comprising a plurality of acoustic emission sensors.

4. The method according to claim 1, where the adaptive filtering comprises filtering by a linear finite impulse response filter.

5. The method according to claim 1, where the adaptive filtering comprises filtering by a recursive infinite impulse response filter.

6. The method according to claim 1, further comprising:

calculating a square of a magnitude of coherence between the discrete acoustic noise reference signal and the discrete output signal to obtain the first correlation value; and calculating a square of a magnitude of coherence between the discrete reference noise signal and the discrete output signal to obtain the second correlation value.

7. The method according to claim 1, where adaptively filtering the acoustic noise reference signal further comprises:

calculating a plurality of filter coefficients using a process selected from the group consisting of a normalized least mean square process, recursive least mean square process, or proportional least mean square process.

8. The method according to claim 1, where the discrete output signal is received from a microphone array having at least one directional microphone.

9. The method according to claim 1, where the noise compensated digital audio signal is filtered by a noise suppression filter.

10. A non-transitory computer-readable storage medium having processor executable instructions to reduce background noise in an audio signal, by performing the acts of:

detecting an acoustic signal by converting sound into digital data;

detecting structure-borne noise by an acoustic emission sensor to obtain an acoustic noise reference signal;

digitizing the acoustic noise reference signal to obtain a discrete acoustic noise reference signal; and detecting noise by a reference microphone to obtain a reference noise signal;

digitizing the reference noise signal to obtain a discrete reference noise signal;

calculating a correlation between the digital data and the discrete acoustic noise reference signal to obtain a first correlation value;

calculating a correlation between the digital data and the discrete reference noise signal to obtain a second correlation value; and adaptively filtering the discrete acoustic noise reference signal to obtain a noise estimate signal, if the first correlation value is greater than the second correlation value;

adaptively filtering the discrete reference noise signal to obtain the noise estimate signal if the first correlation value is not greater than the second correlation value; and subtracting the noise estimate signal from the digital data to obtain a noise compensated digital audio signal.

11. The non-transitory computer-readable storage medium of claim 10, further comprising:

processor executable instructions that cause a processor to perform the acts of:

adaptively filtering the discrete acoustic noise reference signal to obtain an noise estimate signal and;

subtracting the noise estimate signal from the digital data.

12. A noise reduction system comprising:

a microphone configured to detect an acoustic signal;

a first digitizer configured to convert an output of the microphone and provide a digitized microphone output signal;

an acoustic sensor configured to detect structure-borne noise;

a second digitizer configured to convert an output of the acoustic sensor and provide a digitized acoustic noise reference signal; and a reference microphone configured to detect noise;

a digitizer configured to digitize an output of the reference microphone and provide a digitized reference microphone noise signal;

a first correlation circuit configured to calculate a correlation between the digitized microphone output signal and the digitized acoustic noise reference signal to obtain a first correlation value;

a second correlation circuit configured to calculate a correlation between the digitized microphone output signal and the digitized reference microphone noise signal to obtain a second correlation value;

a signal processor configured to adaptively filter the digitized acoustic noise reference signal to obtain a noise estimate signal, if the first correlation value is greater than the second correlation value;

the signal processor configured to adaptively filter the digitized reference microphone noise signal to obtain the noise estimate signal, if the first correlation value is not greater than the second correlation value; and a subtraction circuit configured to subtract the noise estimate signal from the digitized microphone output signal to produce a noise compensated digital audio signal.

13. The system of claim 12, where the microphone comprises a plurality of microphones.

14. The system according to claim 13, where the plurality of microphones includes at least one directional microphone.

15. The system of claim 12, where the acoustic sensor comprises a plurality of acoustic emission sensors.

16. The system according claim 15, where the plurality of acoustic emission sensors is external to the microphone.

17. The system according to claim 12, where the signal processor is configured to calculate a square of a magnitude of coherence between the digitized acoustic noise reference signal and the digitized microphone output signal to obtain the first correlation value, and calculate a square of a magnitude of coherence between the digitized reference microphone noise signal and the digitized microphone output signal to obtain the second correlation value.

18. The system according to claim 12, where the signal processor adaptively filters using an adaptive filter that includes a plurality of filter coefficients, the filter coefficients calculated using a process selected from the group consisting of a normalized least mean square process, recursive least mean square process, the proportional least mean square process.

19. The system according to claim 12, where the acoustic emission sensor is located in a portion of the microphone.

20. The system according to claim 12, further comprising a noise suppression filter configured to filter the noise compensated digital audio signal.

* * * * *